United States Patent [19]

Higgins

[11] 4,054,503

[45] Oct. 18, 1977

[54] PORTABLE METAL RECOVERY APPARATUS

[75] Inventor: David L. Higgins, Palos Verdes Estates, Calif.

[73] Assignee: Ag-MET, Inc., Frackville, Pa.

[21] Appl. No.: 732,407

[22] Filed: Oct. 14, 1976

[51] Int. Cl.[2] ..... C25C 1/20; C25C 7/00

[52] U.S. Cl. ..... 204/271; 204/222; 204/234; 204/237

[58] Field of Search ..... 204/222, 234, 237, 271, 204/275

[56] References Cited

U.S. PATENT DOCUMENTS

| | | | |
|---|---|---|---|
| 1,862,663 | 6/1932 | Curtis | 204/271 |
| 2,997,438 | 8/1961 | James et al. | 204/275 X |
| 3,397,135 | 8/1968 | Otto | 204/271 X |
| 3,450,622 | 6/1969 | Cothran | 204/234 |
| 3,560,366 | 2/1971 | Fisher | 204/271 X |
| 3,663,416 | 5/1972 | Cooper et al. | 204/271 X |
| 3,718,552 | 2/1973 | Mortell | 204/275 X |

*Primary Examiner*—Arthur C. Prescott

*Attorney, Agent, or Firm*—Fitzpatrick, Cella, Harper & Scinto

[57] ABSTRACT

Portable apparatus is disclosed for recovering metal from metal bearing solutions. The apparatus includes a chamber arranged to be mounted on a container for the solution to establish a fluid flow path between an anode and cathode in the chamber for deposition of metal on the cathode, the unit being arranged to prevent unauthorized removal of deposited metal from the cathode.

20 Claims, 4 Drawing Figures

Fig. 1.
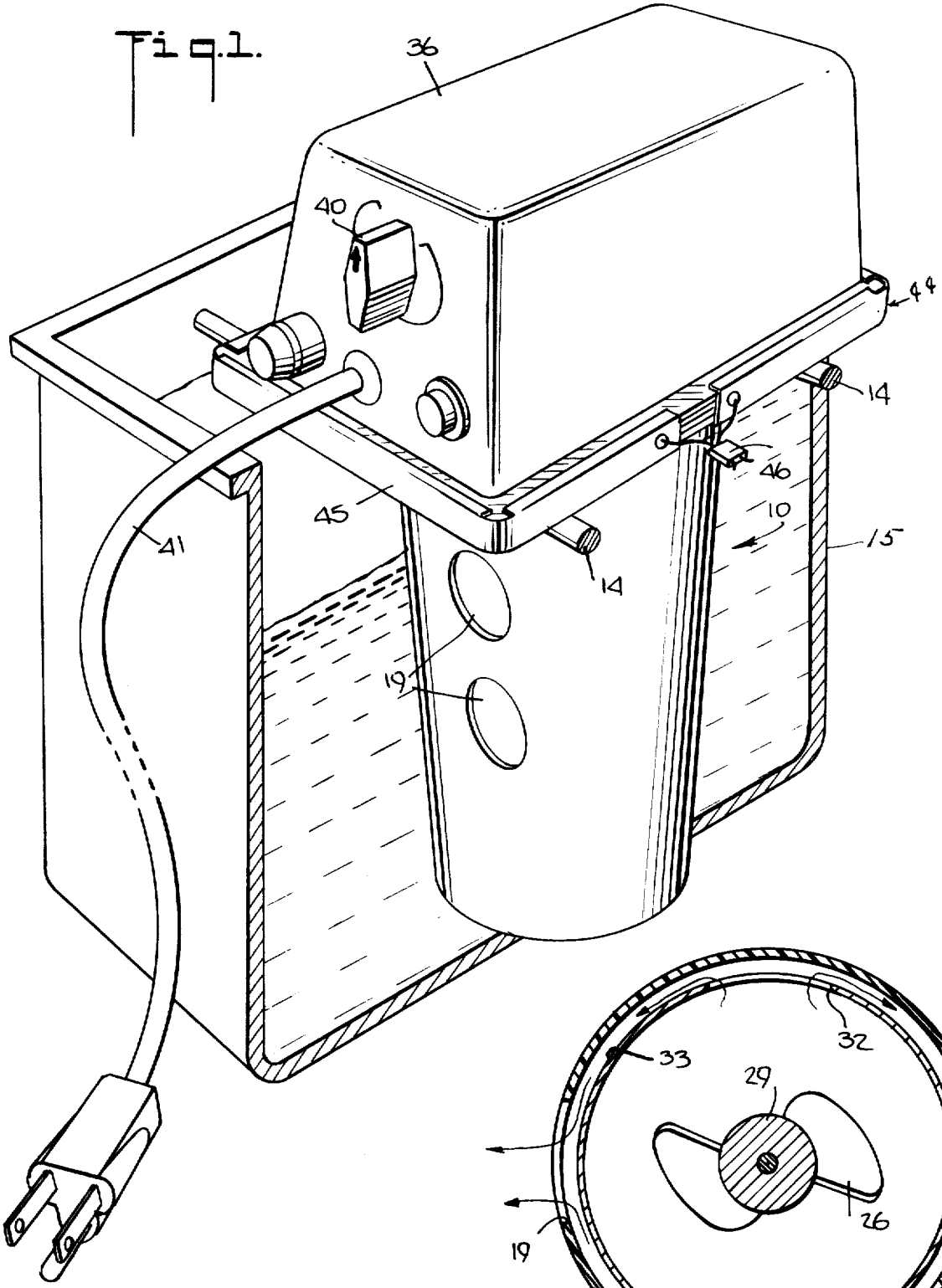
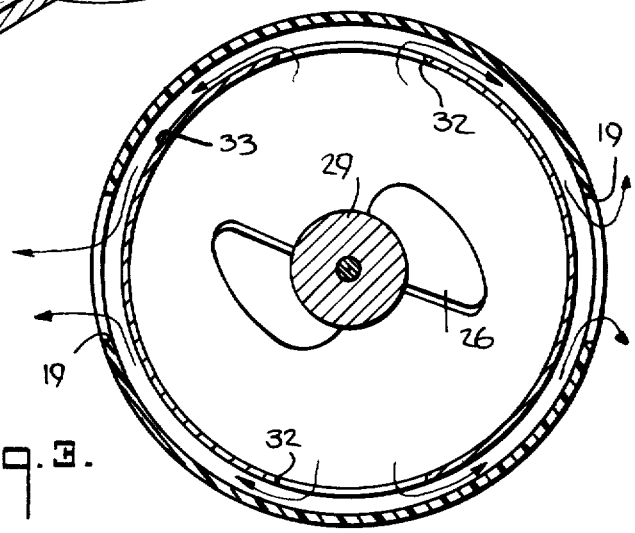
Fig. 3.

36
40
39
27
34
22
42b
41
21
24
35
23
25
42a
15
37
31
45
20
12
31
12
14
11
14
32
33
19
19
10
19
19
30
32
3
3
29
26
16
17

36
40
37
41
42a
34
42b
27
22
10
21
45
44
32
33
45
46

PORTABLE METAL RECOVERY APPARATUS

BACKGROUND OF THE INVENTION

1. Field of the Invention

This invention relates to apparatus for recovering metal from a bath or liquid solution, and more particularly to portable apparatus which may conveniently be immersed into and removed from a metal bearing solution but which is so arranged as to inhibit tampering and unauthorized removal of recovered metal. Since the invention is intended primarily for recovery of silver, the following disclosure will refer to a silver recovery apparatus, although those skilled in the art will readily appreciate that the apparatus may be adapted as well for the recovery of other metals.

2. Description of the Prior Art

It is well known that photographic fixing solutions wash silver from unsensitized areas of exposed film. The silver bearing fixer, when it is spent, is either disposed of or is processed by any of a variety of recovery systems by which the silver is removed from the solution so that both the silver and the solution may be reused.

Referring to one known system described in U.S. Pat. No. 3,926, 768, silver is recovered from spent photographic solutions by feeding the spent solutions into a pre-collecting vessel where the solution collects until a predetermined volume has been received, at which time it is automatically dispensed, by a self-triggering syphon, into an electrolysis chamber, and direct current is automatically turned on for a predetermined period of time between an anode and a cathode in the chamber to plate out the silver onto the cathode while a magnetic agitator is energized to maintain the unplated silver in suspension in the solution. The system thus disclosed is intended for permanent installation and is complicated by a pre-collection chamber and equipment for effecting self-triggering syphoning automatically to dispense a predetermined volume of solution from the pre-collection chamber to an electrolysis chamber. This patent also describes other known systems for removing silver from solutions, and notes the disadvantages associated with each.

In the development of this technology those skilled in the art recognized the need for a small, economical, and portable recovery unit. Thus, such a unit has been developed wherein a cathode and an anode depend from an upper housing which can be removably mounted on a container for the solution. The cathode is rectangular in horizontal cross-sections and is open at its lower end, while the anode is a cylindrical rod disposed within the cathode. A propeller is also mounted within the confines of the cathode and is intended to circulate solution from the container in the area confined within the cathode during electrolysis.

An important disadvantage of this type of portable unit resides in the fact that since the anode is not equidistantly spaced from the inner surfaces of the cathode, but rather is closer to certain areas of the cathode than to other such areas, the silver, as it is plated out of solution, builds up on those areas of the cathode immediately adjacent the anode and eventually shorts out the electrolysis circuit terminating the process while a substantial area of the cathode is hardly plated with silver, if at all.

Another problem that, as far as I am aware, has not been dealt with by innovators in the art is the possibility of tampering with recovery apparatus and removing therefrom the high purity, and therefor quite valuable, plated silver. Thus, when electrolysis is completed, the cathode is normally withdrawn from the unit and sent to a facility at which the silver is removed. However, in many recovery units, and especially portable units of the type referred to above, it is a simple matter to lift the unit from the solution and, since the bottom of the cathode is open, to scrape the plated silver off its inner surface, particularly since the majority of the silver tends to plate onto a relatively small surface area of the cathode.

SUMMARY OF THE INVENTION

Accordingly, I contribute by the present invention, a silver recovery apparatus which is portable so that it may be conveniently mounted for immersion into a silver bearing solution container, is efficient in that silver deposition on the cathode is uniform, and is tamper proof in that access to the plated silver may not be had even though provision is made for the free flow of solution from the container into the recovery unit and back into the container.

One aspect of the present invention resides in the provision of apparatus of the class described which includes an electrolysis chamber open at the top and having side wall means and a bottom wall, means normally securing the top of the chamber against access to the interior thereof, means defining an aperture in the bottom wall and at least one opening in in the side wall means, a first electrode positioned in the chamber adjacent the side wall means, means defining at least one opening in the first electrode, a second electrode of opposite polarity than that of the first electrode and positioned at or near the center of the chamber, an impeller, and means for driving the impeller to draw fluuid into the chamber and to expel same from the chamber via the aperture and openings. The opening in the first electrode is disposed so as to be out of register with the opening in the chamber wall means, and means are provided for passing an electric current between the electrodes and through the solution in the electrolysis chamber to deposit silver from the solution onto one of the electrodes.

The electrolysis chamber and the first electrode are preferably axially substantially coextensive, of cylindrical configuration, and formed with two pairs of openings, the respective openings in each being 180° apart and the openings in the chamber being 90° out of register with the openings in the first electrode and being axially equidistant from the bottom wall. Moreover, the chamber is formed with radially extending flange means for supporting same on a vessel containing silver bearing solution to position the openings below the surface of the solution, and the means normally securing the top of the chamber against access to its interior may comprise a plate covering the open top of the chamber and sealed to the flange.

More specifically, the first electrode is cylindrical and constitutes the cathode upon which deposition of the silver will occur and the second electrode, the anode, is a cylindrical member of considerably smaller diameter extending substantially along the longitudinal axis of the chamber. The impeller may take the form of a propeller conveniently mounted at the lower end of a drive shaft co-axial with the anode.

Sealing the top of the chamber against access, and arranging the openings in the chamber side walls out of registry with those in the cathode prevent the possibility of extending a tool through both sets of openings to scrape plated silver off the inner surface of the cathode. However, the outer surface of the cathode would be accessible through the chamber wall openings. Accordingly, I prefer to coat the outer surface of the cathode, or at least those portion of its outer surface opposite the openings in the chamber, with an insulating material so that silver will not be deposited on those coated areas.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

BRIEF DESCRIPTION OF THE DRAWING

Specific embodiments of the invention have been chosen for purposes of illustration and description, and are shown in the accompanying drawing forming a part of the specification wherein:

FIG. 1 is an assembly view, illustrating apparatus according to the invention in its operative environment;

FIG. 3 is a cross-sectional view taken along the line 3–3 of FIG. 2; and

DETAILED DESCRIPTION OF THE PREFERRED EMBODIMENT

Figure 2:
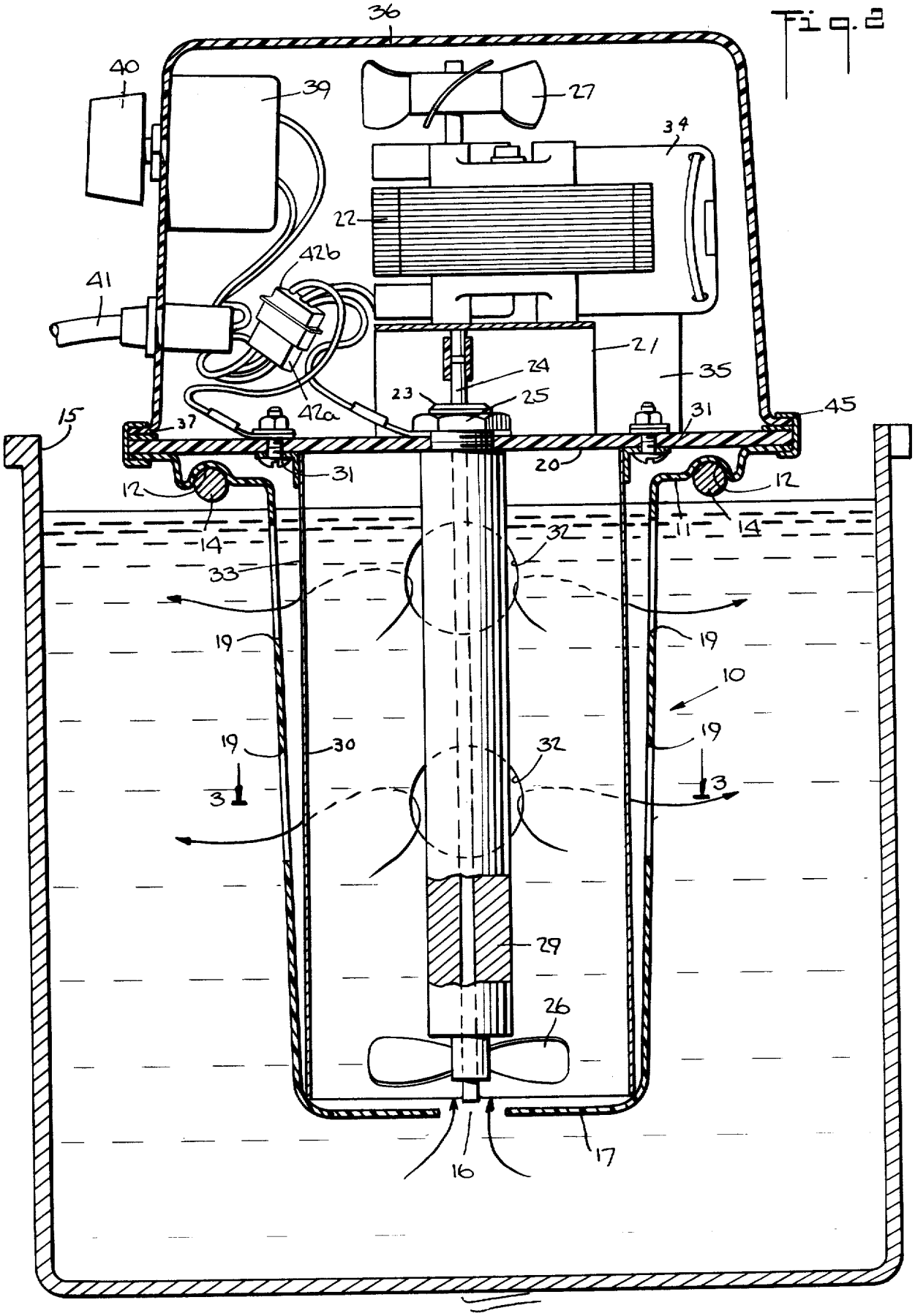
FIG. 2 is a longitudinal sectional view of the apparatus illustrated in FIG. 1.

Referring now to FIGS. 1 and 2, there is shown an electrolysis chamber 10 which is generally cylindrical in shape and formed with an integral, outwardly extending flange 11 at its upper end. The flange is recessed as at 12 so that the chamber may rest on parallel rods 14 across the top of a container 15 for silver bearing solution. The container 10 is also shown as having a central aperture 16 in a bottom wall 17 and two pairs of vertically spaced openings 19 in its side wall, these pairs of openings being circumferentially spaced 180° apart.

The plate 20 of insulating material is positioned across the top opening of the chamber 10 and is coextensive with the flange 11, and this plate supports a bracket 21 upon which is mounted on electric A.C. motor 22 which drives a shaft 24 extending vertically downwardly through a nut 25 and the plate 20 and to the bottom of which is fixed a propeller 26 and to the upper end of which is mounted a fan 27 for cooling the motor.

A cylindrical graphite rod 29 is threaded to the nut 25 and extends down through the insulating plate 20 towards the aperture 16 of the wall 17 and surrounds the lower parts of the shaft 24. A suitable washer 23 seals the space between shaft 24 and nut 25.

A cylinder 30, which may be formed of stainless steel, for example, is fixed to the underside of the plate 20 by suitable bolted brackets 31, and it will be noted that this cylinder is of a diameter slightly less than that of the chamber 10 and is so disposed therein that its inner surface is radially offset outwardly of the perimeter of the aperture 16 in bottom wall 17. The cylinder is preferably split lengthwise to permit easy removal of the silver deposited thereon simply by expanding same after removal from the apparatus to a flat configuration and flexing it. Opposed pairs of openings 32 (only one pair being shown), similar to the openings 19 in the chamber 10 are formed in the cylinder 30 and at about the same distance from the bottom wall 17. However, these openings 32 are oriented 90° about the vertical axis of the chamber with respect to the openings 19 so that respective pairs of openings in the two members do not register.

An auxiliary winding 34 is conveniently wound around the field coil of the motor 22, the induced current in the coil is rectified by a full wave rectifier 35 and one side of the rectified D.C. current is delivered to the cylinder 30 through one of the bolted brackets 31 while the other side is delivered to the rod 29 through the nut 25 to provide a circuit for electrolysis of silver bearing solution in the chamber. The polarity of this circuit is such that the rod 29 is the anode and the cylinder 30 is the cathode upon which silver is plated.

Figure 4:
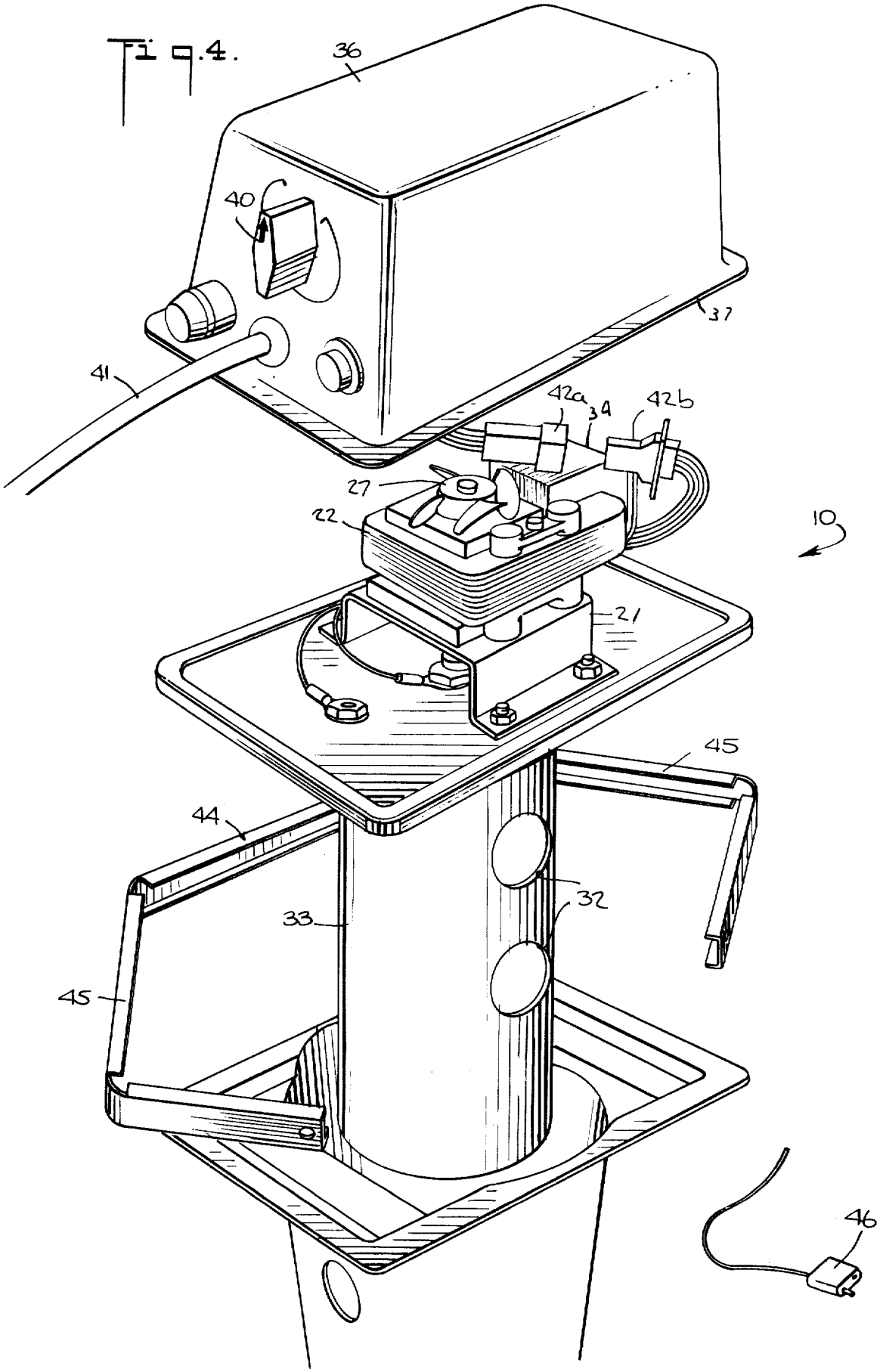
FIG. 4 is an exploded view of the apparatus according to the present invention.

FIGS. 2 and 4 illustrate a cover 36 formed with a peripheral flange 37 for a purpose later to be described. A conventional time 39 (FIG. 2) is mounted within the cover and by means of which the energization of the unit may be selectively timed by a suitably calibrated timing knob 40 (FIGS. 1, 2 and 4). The main A.C. power line 41 thus supplies the timer, and a pilot light (not shown) if desired, and may be suitably fused all in a manner that will be readily familiar to those skilled in the art. Operating power is delivered to the motor 22 by connection of electrical couplings 42*a* and 42*b* (FIG. 2).

Turning now to FIGS. 1, 2 and 4, there is shown a clamping bracket 44 that is flexible at its corners and has upper and lower flanges 45. To assemble the unit, the couplings 42*a* and 42*b* are connected, the cover 36 is placed atop the insulating plate 20 and the latter is positioned on the flange 11 of the chamber 10. A suitable sealing gasket may be applied between the parts and the clamping bracket 44 is positioned so that its flanges 45 encompass the top surface of the cover flange 37 and the lower surface of the flange 11. The open ends of the bracket 44 are drawn together and a locking seal 46 (FIGS. 1 and 4) is applied thereto in any convenient manner.

Upon the application of power to the unit, the impeller 26 draws solution in through the aperture 16 in bottom wall 17 and circulates it around within the cylinder 30 out through openings 32 and 19 in the cylinder and chamber wall means, respectively, and back to the container. Silver in the solution passing through the unit is deposited onto the cathode 30. However, as stated, the outer surface of the cathode, or at least those areas of that surface that face the openings 19 in the chamber are coated as at 33 (FIGS. 3 and 4) to prevent the deposition of silver thereon. The coating may consist of any convenient insulating material which of course must be compatible with the silver bearing solution and commercially available acetone based primers have been found to be suitable for this purpose.

From the foregoing description, it will be seen that the present construction contributes a recovery apparatus which is portable, efficient and economical, which provides for uniform deposition of silver on the cathode, and which responds to the above noted practical observation concerning the value and accessibility of plated silver in certain known recovery devices. Thus, the present apparatus prevents unauthorized access to the plated silver through the top of the chamber without breaking the seal securing the clamping bracket that retains the parts in assembled condition, or through the fluid circulation openings in the chamber side wall means.

I believe that the construction and operation of my novel sliver recovery apparatus will now be understood and that the several advantages thereof will be fully appreciated by those persons skilled in the art.

What is claimed is:

1. Apparatus for recovering metal from metal bearing solutions comprising: an electrolysis chamber open at the top and having side wall means and a bottom wall, means normally securing the top of said chamber against access to the interior thereof, means defining an aperture in said bottom wall and at least one opening in said side wall means, a first electrode positioned in said chamber adjacent said side wall means, means defining at least one opening in said first electrode, a second electrode of opposite polarity than that of said electrode and positioned at or near the center of said chamber, an impeller, means for driving said impeller to draw fluid into said chamber and to expel same from said chamber via said aperture and said openings, said opening in said first electrode being disposed so as to be out of register with said opening in said chamber wall means, and means for passing an electric current between said electrodes and through the solution in said electrolysis chamber to deposit metal from said solution onto one of said electrodes.

2. Apparatus according to claim 1, wherein said electrolysis chamber and said first electrode are axially substantially coextensive and of cylindrical configuration.

3. Apparatus according to claim 2, wherein said first electrode is split lengthwise.

4. Apparatus according to claim 2, wherein said first electrode is so disposed in said chamber that the inner surface thereof is radially offset outwardly of the perimeter of said aperture in said bottom wall.

5. Apparatus according to claim 1, wherein said electrolysis chamber and said first electrode are axially substantially coextensive, of cylindrical configuration and formed with two pairs of openings, the respective openings in each being 180° apart and the openings in said chamber being 90° out of register with the openings in said electrode.

6. Apparatus according to claim 5, wherein said first electrode is a cathode and the areas of the surface thereof opposite the openings in said chamber are coated with an insulating material to prevent the deposition of metal thereon.

7. Apparatus according to claim 1, wherein said respective openings in said chamber and said first electrode are substantially axially equidistant from said bottom wall.

8. Apparatus according to claim 1, wherein said first electrode is a cathode and the areas of the surface thereof opposite the openings in said chamber are coated with an insulating material to prevent the deposition of metal thereon.

9. Apparatus according to claim 1, wherein said electrolysis chamber is formed with radially extending flange means for supporting same on a vessel containing metal bearing solution to position said openings below the surface of said solution.

10. Apparatus according to claim 9, wherein said means normally securing the top of said chamber includes a plate covering the open top of said chamber and sealed to said flange.

11. Apparatus according to claim 1, including means defining two oppositely disposed pairs of vertically spaced openings in said chamber wall means and in said first electrode, said respective pairs of openings being axially equidistant from said bottom wall.

12. Apparatus for recovering metal from metal bearing solutions comprising: an electrolysis chamber open at the top and having side wall means and a bottom wall, means normally securing the top of said chamber against access to the interior thereof, means defining an aperture in said bottom wall and at least one opening in said side wall means, a cathode positioned in said chamber adjacent said side wall means, means defining at least one opening in said cathode, an anode positioned at or near the center of said chamber, an impeller adjacent the bottom of said chamber and means to drive said impeller to draw fluid into said chamber and to expel same from said chamber via said openings, said openings in said cathode being disposed so as to be out of register with said openings in said chamber wall means, at least that portion of the surface of said cathode opposite the openings in said chamber side wall means being coated with an insulating material to prevent the deposition of silver thereon, and means for passing an electric current between said cathode and said anode and through the solution in said electrolysis chamber to deposit metal from said solution onto said cathode.

13. Apparatus according to claim 12, wherein said electrolysis chamber and said cathode are axially coextensive and of cylindrical configuration.

14. Apparatus according to claim 13, wherein said cathode is split lengthwise.

15. Apparatus according to claim 13, wherein said cathode is so disposed in said chamber that the inner surface thereof is radially offset outwardly of the perimeter of said aperture in said bottom wall.

16. Apparatus according to claim 12, wherein said electrolysis chamber and said first electrode are axially substantially coextensive, of cylindrical configuration and formed with two pairs of openings the respective openings in each being 180° apart and the openings in said chamber being 90° out of register with the openings in said electrode.

17. Apparatus according to claim 12, wherein said electrolysis chamber is formed with radially extending flange means for supporting same on a vessel containing metal bearing solution to position said openings below the surface of said solution.

18. Apparatus according to claim 12, wherein said respective openings in said chamber and said first electrode are substantially axially equidistant from said bottom wall.

19. Apparatus according to claim 17, wherein said means normally securing the top of said chamber includes a plate covering the open top of said chamber and sealed to said flange.

20. Apparatus according to claim 12, wherein said anode is a cylindrical member extending substantially along the longitudinal axis of said chamber and said impeller is mounted at the lower end of a drive shaft coaxial with said anode.

* * * * *